US005818040A

United States Patent [19]

Kinoshita et al.

[11] Patent Number: 5,818,040

[45] Date of Patent: Oct. 6, 1998

[54] NEUTRAL PARTICLE BEAM IRRADIATION APPARATUS

[75] Inventors: Keizo Kinoshita; Seiji Samukawa, both of Tokyo, Japan

[73] Assignee: NEC Corporation, Tokyo, Japan

[21] Appl. No.: 748,994

[22] Filed: Nov. 14, 1996

[30] Foreign Application Priority Data

Nov. 14, 1995 [JP] Japan ..... 7-295132

[51] Int. Cl.[6] ..... H05H 3/00

[52] U.S. Cl. ..... 250/251

[58] Field of Search ..... 250/251, 423 R, 250/492.21

[56] References Cited

U.S. PATENT DOCUMENTS

| | | | |
|---|---|---|---|
| 3,846,636 | 11/1974 | Zehr et al. | 250/251 |
| 4,140,576 | 2/1979 | Fink et al. | 250/251 |
| 4,361,762 | 11/1982 | Douglas | 250/251 |
| 4,500,563 | 2/1985 | Ellenberger et al. | 427/38 |
| 4,649,278 | 3/1987 | Chutjian et al. | 250/423 R |
| 4,933,546 | 6/1990 | Muntz et al. | 250/251 |
| 4,960,990 | 10/1990 | Lavan et al. | 250/251 |
| 5,177,358 | 1/1993 | Roberts et al. | 250/251 |
| 5,466,929 | 11/1995 | Sakai et al. | 250/251 |

FOREIGN PATENT DOCUMENTS 0 522 296 1/1993 European Pat. Off. .

OTHER PUBLICATIONS

T. Ahn et al., "Negative ion measurements and etching in a pulsed–power inductively coupled plasma in chlorine", Plasma Sources Sci. Technol., vol. 5, 1996, pp. 139–144.

*Primary Examiner*—Bruce Anderson
*Attorney, Agent, or Firm*—Young & Thompson

[57] ABSTRACT

The present invention provides a neutral particle beam treatment apparatus which includes the following elements. A plasma generator is provided for generating a plasma from a treatment gas by alternation of application and discontinuation of a high frequency field. A negative ion accelerator is also provided for fetching negative ions from the plasma generated by the plasma generator and acceleration thereof to cause a negative ion beam. A neutralizer is further provided for neutralizing the negative ion beam to cause a neutral particle beam. A holder is still further provided for holding a sample at a position at which the neutral particle beam is irradiated.

8 Claims, 3 Drawing Sheets

NEUTRAL PARTICLE BEAM IRRADIATION APPARATUS

BACKGROUND OF THE INVENTION

The present invention relates to a neutral particle beam irradiation apparatus, and more particularly to an apparatus for generating a neutral particle beam from negative ions for irradiation onto a semiconductor substrate to carry out a surface treatment of the semiconductor substrate such as etching and cleaning thereof.

An ion etching method is one of the surface treatment techniques and etching techniques by use of plasma. In accordance with the ion etching method, ionized positive gases in the plasma are accelerated by a field to be irradiated onto a solid sample so that a chemical reaction having appeared on a surface of the solid sample and sputtering phenomenon are utilized for etching. Other than such technique utilizing the charged particles, there is a technique to irradiate neutral particles onto a sample for etching.

In the Japanese laid-open patent publication No. 61-248428, it is disclosed that the positive ion is neutralized by a charge-exchange phenomenon appearing in passing through a neutral gas atmosphere for subsequent irradiation onto the sample for etching the same. In such neutral particle beans treatment apparatus, positive ions such as chlorine and argon are generated by an ion source so that a bias voltage is applied thereto to form an ion beam. The ion beam passes through the charge-exchange section having a length of 1 meter and including chlorine gas to cause the charge-exchange for obtaining neutralization of the particle. The remaining ion having not been neutralized is applied with a field in a vertical direction to the beam for removal of the ion to leave only the neutral particles so that the neutral particle beam is irradiated onto the sample.

In the Japanese laid-open patent publication No. 4-343421, it is disclosed that a micro-channel plate with micropores is used to neutralize positive ions in the plasma and irradiate the same onto a substrate. In such neutral particle beam treatment apparatus, micropores are used to improve efficiency of neutralization of the of the positive ions as compared to the charge-exchange in the gas atmosphere.

FIG. 1 is a view illustrative of a neutral particle beam treatment apparatus using a micro-channel with micropores. A plasma chamber 101 is separated by a micro-channel plate 103 from an etching chamber 102. The micro-channel plate 103 is formed with micro-channel pores 104 which penetrate the micro-channel plate 103. First and second surface electrodes 105 and 106 are formed in the vicinity of the micro-channel pores 104 and on both sides of the plate 103.

Into the plasma chamber 101, a chlorine gas is introduced through a gas introduction port 107. In the plasma chamber 101, a high frequency electrode 108 is provided for a high frequency glow discharge to generate plasma: A predetermined voltage is applied to between the first and second surface electrodes 105 and 106 by an elects multiplier power source 109. Neutral particles such as radicals in the plasma pass through the micro-channel pores 104 for irradiation as a neutral particle beam onto a sample 111. The positive ions are neutralized by the electron multiplication of the micro-channel pores 104 and irradiated as a neutral particle beam onto the sample 111.

Since the use of micro-channel pores makes it possible to neutralize almost al of the positive ions, it is not necessary to remove non-neutralized ions by applying a field in the vicinity of the sample.

In the Applied Physics Letters, vol. 63–24, 1993, p. 3355, it is disclosed that a neutral particle beam is generated by utilizing a molecular flow having been generated by a pressure difference between two chambers which are separated by a micro-pore plate. In general, the neutral particle beam having been generated by the pressure difference is used for etching and surface treatment after the gas was heated to form hot molecular beams.

When the positive ion in the plasma is used for etching and ion etching, in a specific pattern, charge particles caused by electrons in the plasma are accumulated on a substrate surface. It is therefore difficult to obtain in-plane uniform etching or desired etching. Normally, except on a region to be processed by ion beam, the photo-resist pattern is coated. Since the photo-resist is dielectric, the charge appears due to electrons supplied by the plasma. As a result, an orbit of the positive ions incident onto the substrate is changed whereby an accurate isotropic etching is difficult. Further, microstructures such as a thin oxide film for transistors over a substrate might be broken by the accumulated charge.

If, however, the neutral particles are used, then there is no problem such as the charged particles. In the Japanese laid-open patent publication No. 61-248428, it is disclosed that for neutralization electrons are taken from gas for recombination of electrons and positive ions. It is thus difficult to neutralize the positive ion beam completely. It is likely that the density of the neutral particles is low and a beam intensity is weak.

Further, in order to carry out an electron exchange, it is necessary that the positive ion is accelerated by not less than 100 eV. It is also necessary that the gas atmosphere for charge exchange to the plasma generation part is maintained at a constant difference in pressure, leading to a large exhaust system and a large apparatus as well as the increased cost.

In the Japanese laid-open patent publication No. 4-343421, it is disclosed that in passing through the micropores of the micro-channel plate, a chemical reaction with etching gas and a sputtering phenomenon appear on surfaces of the micropores whereby dusts may be generated in the chamber and a reaction product may be dropped onto the substrate. For those reason, it is difficult to form micro-pattern. Since it is further difficult to control energy of the beam, it is difficult to adopt the etching conditions for various etching materials.

When the hot molecular beam is used, it is difficult to enlarge the beam diameter up to a wafer level, for which reason it is necessary to provide a large number of nozzles. This results in a scaling up of the exhaust system and increase of the cost. It is further difficult to obtain a practically required etching rate.

In the above circumstances, it had been required to develop a novel neutral particle beam treatment apparatus suitable for micro-pattern formations and being capable of an accurate energy control of a high intensity beam.

SUMMARY OF THE INVENTION

Accordingly, it is an object of the present invention to provide a novel neutral particle beam treatment apparatus free from any disadvantages as described above.

It is a further object of the present invention to provide a novel neutral particle beam treatment apparatus suitable for micro-pattern formations.

It is a still further object of the present invention to provide a novel neutral particle beam treatment apparatus being capable of an accurate energy control of a high intensity beam.

The above and other objects, features and advantages of the present invention will be apparent from the following descriptions.

The present invention provides a neutral particle beam treatment apparatus which includes the following elements. A plasma generator is provided for generating a plasma from a treatment gas by alternation of application and discontinuation of a high frequency field. A negative ion accelerator is also provided for fetching negative ions from the plasma generated by the plasma generator and acceleration thereof to cause a negative ion beam. A neutralizer is further provided for neutralizing the negative ion beam to cause a neutral particle beam. A holder is still further provided for holding a sample at a position at which the neutral particle beam is irradiated.

In accordance with the above apparatus, application and discontinuation of the high frequency field are repeated to generate a large amount of negative ions which are accelerated to cause a negative ion beam. Excess electrons of the negative ion are removed therefrom to cause the neutral particle beam so that the neutral particle beam is irradiated onto a sample for surface treatment. Electrons having been generated during the application of the high frequency field are bonded with residual treatment gas during the discontinuation of the high frequency field application. Since the negative ion is easily removed as compared to the positive ion, it is easy to obtain a neutral particle beam with a sufficient intensity.

The plasma generator has the following elements. A filed application discontinuation section is provided for discontinuation of the application of the high frequency field for a time which is longer than a time when electrons in the plasma are bonded with residual gas to generate a negative ion gas but shorter than a time when the electron density of the plasma is dropped to have the plasma disappear. A high frequency field application section is provided for applying a high frequency field for a sufficient time for recovery of the dropped electron energy of the plasma, wherein the energy drop has appeared. A repeating section is further provided for repeating the application of the high frequency field and the discontinuation thereof.

In accordance with the above plasma generator, the application of the high frequency field is discontinued for a time longer than a time when electrons in the plasma are bonded with residual gas to generate a negative ion gas but shorter than a time when the electron density of the plasma is dropped to have the plasma disappear. Such application of the high frequency field and the discontinuation thereof are repeated to keep dissociation reaction in static state so that the negative ion is generated efficiently and continuously.

The above negative ion accelerator comprises a grid electrode and a voltage supply for supplying a positive bias to the grid electrode.

In accordance with the above negative ion accelerator, the voltage is applied to the grid electrode to generate a field which fetches the negative ions. A the grid electrode, it is not necessary to do charge-exchange, for which reason a metal mesh may be used. On the grid electrode, no chemical reaction nor surface sputtering phenomenon appears. A micro-processing is facilitated. The neutral particle beam intensity may easily be controlled by controlling the voltage to be applied to the grid and the time duration thereof.

The above negative ion accelerator fetches the negative ion from the plasma and accelerate them during when the application of the high frequency field is discontinued.

In accordance with the above negative ion accelerator, the negative ion is fetched only during when the high frequency field application is discontinued and a large amount of negative ions is generated. When the high frequency field is applied, the amount of the negative ions is unstable. If, however, the application of the high frequency field is discontinued, then a large amount of the negative ions is generated, for which reason the amount of the negative ions fetched is stable and an accurate control of the beam intensity is possible.

The neutralizer is a light source which irradiate a light to the negative ion beam.

In accordance with the above neutralizer, a most outer-shall electron of the negative ion is separated. Since the negative ion has a most outer-shall electron which is likely to be free and the negative ion is likely to be neutral, for which reason it is possible to neutralize the negative ion by irradiation of the light. It is possible to have the most outer-shall electron of the negative ion free by irradiation of a light with a short wavelength.

The neutralizer is provided with an electrode and a high frequency power supply for supplying a high frequency voltage to the electrode.

In accordance with the neutralizer, the high frequency field is applied to the negative ions to separate the most outer shell electrons therefrom.

The neutralizer is the electron beam irradiator for irradiation of the electron beam to the negative ion.

In accordance with the neutralizer, the electron beam is irradiated to the negative ions to separate the most outer shell electrons therefrom.

The neutralizer is the gas introduction section which introduce gas molecules or gas atoms on the passage of the negative ion beam.

In accordance with the above neutralizer, the negative ion beam passes through the gas so that the negative ions have collisions with the gas molecules and gas atoms to cause separation of the most outer shell electrons from the negative ions. The negative ions show separation of only the excess electron or the most outer shell electron so that the negative ions become neutrals The separation of the most outer shell electrons from the negative ions is possible efficiently and at a low collision energy.

BRIEF DESCRIPTIONS OF THE DRAWINGS

Preferred embodiments of the present invention will be described with reference to the accompanying drawings.

PREFERRED EMBODIMENTS

Figure 1:
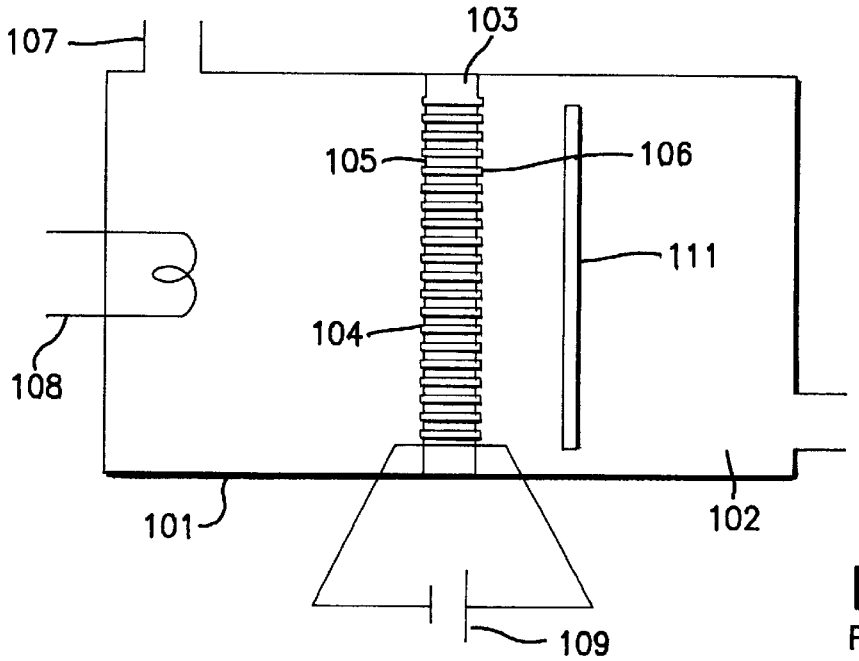
FIG. 1 PRIOR ART
FIG. 1 is a view illustrative of the conventional neutral particle beam treatment apparatus using the micro-channel with micropores.
Figure 2:
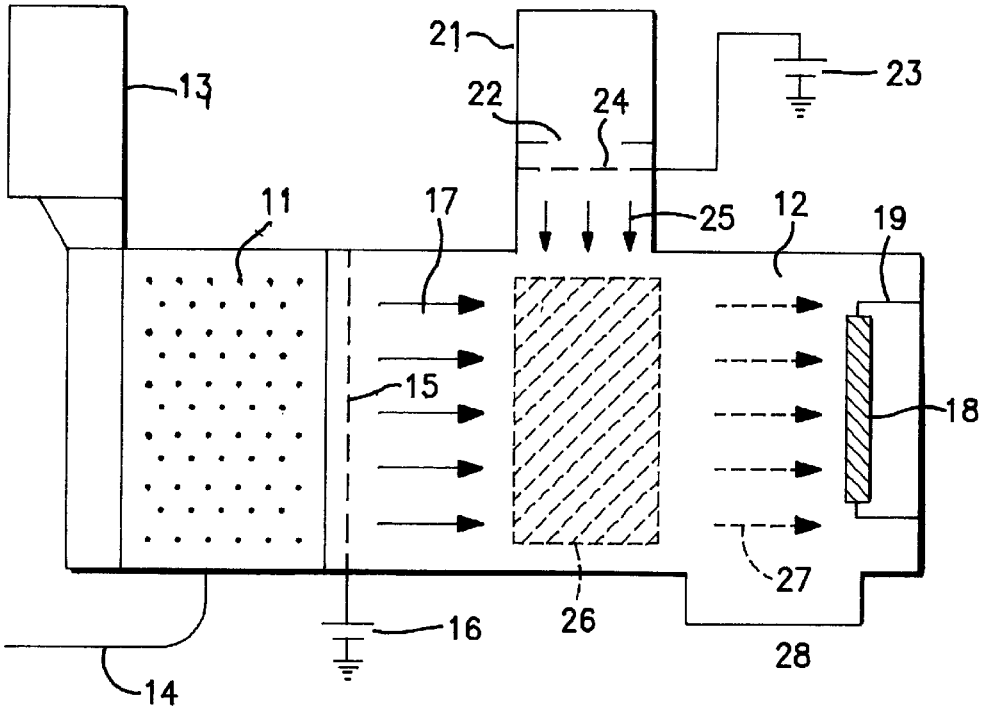
FIG. 2 is a view illustrative of a neutral particle beam treatment apparatus in a first embodiment according to the present invention.

A first embodiment according to the present invention will be described with reference to the drawings wherein there is provided an apparatus for etching a substrate by an neutral particle beam. The apparatus is provided with a plasma generation chamber 11 for generating plasma and an etching chamber 12 for etching a substrate. In the plasma generation chamber 11, a high frequency electrode not illustrated is provided. A microwave power source 13 is provided for supplying a pulse-modulated voltage to the high frequency electrode. The pulse time duration of the microwave power source 13 is set optionally. In the plasma chamber 11, a chlorine gas is introduced via a gas introduction path.

At the boundary between the plasma generation chamber 11 and the etching chamber 12, a meshed grid electrode 15 is provided for fetching the negative ions from the plasma chamber 11 and feeding the negative ions into the etching chamber 12. A constant voltage power source 16 is provided for applying a predetermined voltage to the grid electrode 15. The fetched negative ions are transmitted in the form of beam 17. At the right end of the ethnic chamber 12, a substrate holder 19 is provided for holding a substrate 18. The substrate 18 is held by the substrate holder 19 so that the surface of the substrate 18 is directed vertical to the beam 17.

At the top of the etching chamber 12, a plasma source 21 is provided for irradiating the electron beam in the direction vertical to the path of the negative ion beam 17. In the plasma source 19, an argon gas is introduced. In the vicinity of an opening 22 of the plasma source 21, a grid electrode 24 is provided to be connected to a constant voltage power supply 22. Electrons are generated in the plasma source and then accelerated toward the etching chamber 12 in the form of the electron beam. A region 26 in the etching chamber represent a region on which the negative ion beam 17 and the electron beam 25 do cross to each other at a right angle. The most outer shell electrons of the negative ions are separated therefrom by the electron beam 25 so that the negative ion beam 17 becomes a neutral particle beam 27. In the etching chamber 12, an exhaust port 28 is provided which is connected to a vacuum exhaust system not illustrated.

The microwave power source 13 generates a pulse modulated plasma by pulse modulation of cycles, each comprising ON-time of 10 microseconds and OFF-time of 100 microseconds. The flow rate of the chlorine gas is set at 20 sccm. The gas pressure is set at 4 mTorr. The micro-wave power source 34 is supplied with 1 kW in ON-time. In the plasma generated by the pulse modulation, a large amount of $Cl^-$ ions and a small amount of $Cl_2^-$ ions are generated.

Figure 3:
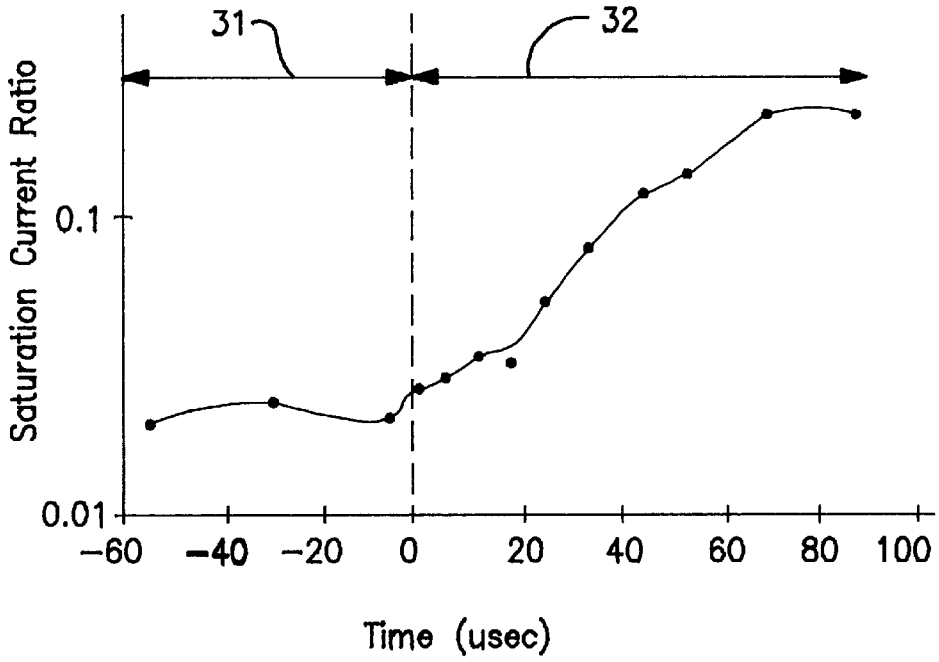
FIG. 3 is a diagram illustrative of an amount of the negative ion generated by a pulse modulation.

FIG. 3 is illustrative of the amount of the negative ions generated by the pulse modulation. It is difficult to generate the negative ions efficiently in the low pressure high density plasma. If, however, power on-off pulse modulation is carried out, then during the OFF-time electrons in the plasma are bonded with residual gases whereby a large amount of the negative ions is generated in the plasma. The time interval 31 represents ON-time whilst the time interval 31 represents OFF-time. When the ON-time is changed to the OFF-time, the time is "0". A saturation current ratio of ion saturation current under −20V to an electron saturation current is varied over times, where a chlorine gas is used.

FIG. 3 shows the followings. During a time interval of 50–100 microseconds after the ON-time is changed to the OFF time, a high density negative ion as high as the electron density of the plasma is generated. When the ON-time is changed to the OFF-time and the plasma electron density is dropped but the plasma does not disappear yet, the OFF-time is changed to the next ON-time so that it is possible to recover the lost plasma electron energy for a short time, for example, about 10 microseconds whereby the dissociation reaction in the plasma achieves a static state. If the chlorine gas is used, the ON-time and the OFF-time are set 10 microseconds and 50–100 microseconds for efficient generation of the negative ions.

The above ON-OFF times are set in generation of the dissociation reaction defined by the kinds of the gas to be used, a power to be applied to the plasma, a time of placing the gas in the chamber and the generation method.

The negative ions generated by the pulse modulation in the plasma chamber 11 are fetched by the field supplied by the grid electrode 15 and accelerated toward the etching chamber 1. The grid electrode 15 is applied with about 30 V. The grid electrode 15 does not need to do charge exchange, for which reason the grid electrode 15 may comprise a meshed metal grid electrode having an area not less than a plasma-uniform area on which plasma may be regarded as uniform. Since the meshed metal grid electrode 15 has an extremely small surface area on which the meshed metal grid electrode 15 is in contact with the negative ions, as compared to the electrode with micro-pores, it is possible to suppress the undesirable surface reaction or sputtering phenomenon. The use of the meshed metal grid 15 having the contact surface area not less than the plasma-uniform area makes it possible to accelerate the negative ions in the straight line toward the etching chamber 12 to generate negative ion beam consisting mainly of $Cl^-$.

The fetched negative ions are likely to be neutralized by discharging the excess ions such as the most outer shell electrons. If an energy is applied to the negative ions for allowing separation of the excess electrons, the negative ions become neutral. For example, the electron beam 25 is generated in the plasma source 21 and then irradiated to the negative ion beam 17 on the region 26 for causing the excess-electron separation from the negative ions. The grid electrode 24 is applied with 10V for fetching electrons from the plasma generated in the plasma source 21.

Since momentum of the negative ion beam almost remains unchanged even when the most outer shell electrons are separated because of the extremely small mass of electron. The momentum obtained by the acceleration of the negative ions remains unchanged when the negative ion beam have become the neutral particle beam and then the neutral particle beam with remaining momentum is then irradiated onto the substrate. The negative ion beam is neutralized to obtain the neutral particle beam of chlorine atoms.

The neutral particle beam 27 is irradiated onto a silicon substrate 18 on which a photo-resist pattern is formed, wherein the substrate 18 is held by the holder 19. The substrate surface not covered by the photo-resist pattern is etched by the neutral particle beam. As a result of observation to the substrate surface by use of the scanning electron microscope, it was confirmed that no charge particle is accumulated on the photo-resist pattern due to the neutral particle beam and an accurate pattern transcribed from the photo-resist pattern is formed on the substrate surface. When a substrate on which a thin oxide film has been formed is etched, no charge particle is accumulated nor local current, which might break a semiconductor device, appears.

The momentum of the neutral particle beam is controllable by controlling the voltage to be applied to the grid electrode 15 which defines the momentum of the negative ion beam to adopt the various etching conditions. Since it is easy to obtain a large amount of the negative ions to obtain the practically required beam intensity.

Figure 4:
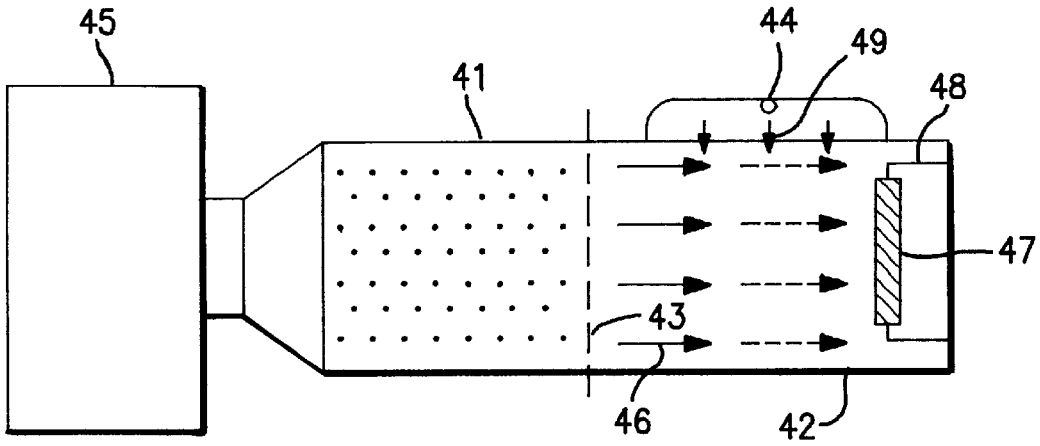
FIG. 4 is a view illustrative of a neutral particle beam treatment apparatus in a second embodiment according to the present invention.

FIG. 4 is illustrative of a neutral particle beam treatment apparatus for neutralizing the negative ions by ultra-violet ray irradiation.

The apparatus is provided with a plasma chamber 41 for generating plasma and an etching chamber 42 for etching the substrate. At the boundary between the plasma chamber 41 and the etching chamber 42, a meshed metal grid electrode 43 is provided. The grid electrode 43 is connected to a constant voltage power supply for applying a predetermined voltage. At the top of the etching chamber 42, an ultra-violet ray irradiation source 44 is provided for irradiating the ultra-violet ray. In the plasma chamber 41, a chlorine gas is introduced via an introduction port not illustrated. Micro-wave power supply 45 is a high frequency power source for applying a pulse-modulated voltage to an electrode not illustrated and provided in the plasma chamber 41.

A negative ion is fetched from the plasma chamber 41 by the field of the grid electrode 43 and accelerated in a direction represented by an arrow mark 46 toward a substrate 47 held by a substrate holder 48 in the etching chamber 42 to thereby form negative ion beams. The negative ion beam 46 receives irradiation of the ultra-violet ray 49 so that the negative ions are neutralized whereby the negative ion beam becomes the neutral particle beam to be irradiated onto the substrate 47.

The neutralization of the negative ion beam can be obtained by applying a high frequency field to the negative ions or by rendering the negative ion bean pass through the neutral gas or plasma gas.

Figure 5:
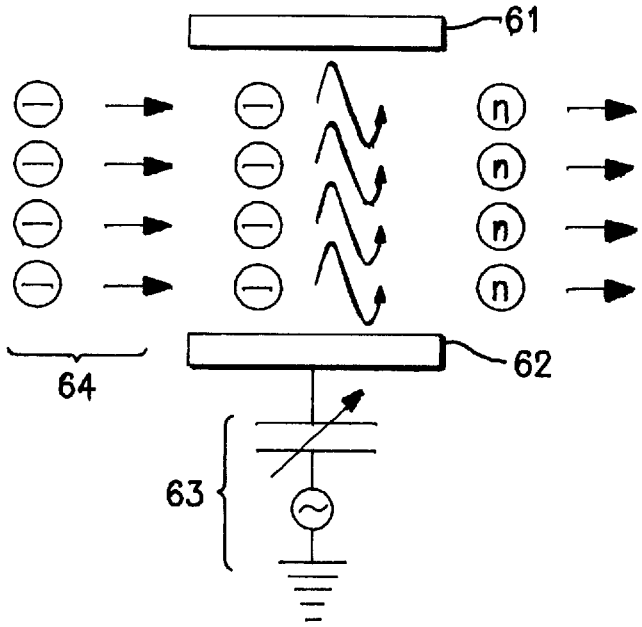
FIG. 5 is a view illustrative of separation of electrons from the negative ions by application of high frequency field.

FIG. 5 is illustrative of separation phenomenon of excess electrons such as most outer shell electrons of the negative ions when applied with the high frequency faied. A pair of electrodes 61 and 62 is applied with a high frequency voltage to apply a high frequency electric field to the negative ions 64. As a result, the negative ions 64 are oscillated so that the excess electrons such as the most outer shell electrons are separated from the negative ions whereby the negative ions then become neutral particles.

Figure 6:
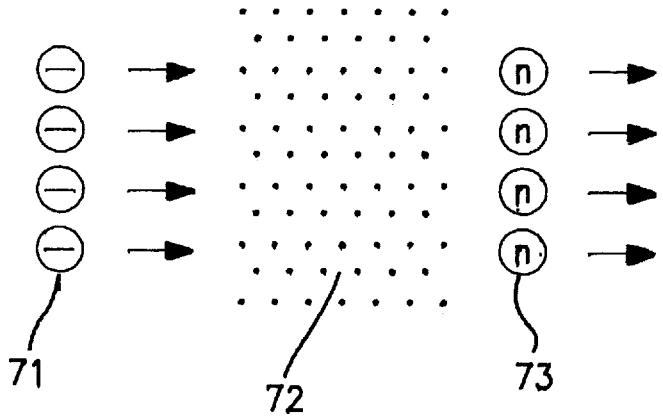
FIG. 6 is a view illustrative of separation of electrons from the negative ions in passing a gas or plasma.

FIG. 6 is illustrative of separation phenomenon of excess electrons such as most outer shell electrons of the negative ions when the negative ion beam passes through the neutral gas. When the negative ions 71 pass through the neutral gas 72, then the negative ions 71 have collision with the neutral gas 72 to cause charge-exchange, namely the excess electrons such as the most outer shell electrons are separated from the negative ions. As a result, the negative ions 71 are neutralized and become the neutral particles 73. If the positive ions pass through the neutral gas 72 contrary to the present invention, then electrons are separated from the neutral gas and then recombined with the positive ions. This process is not efficient and need a large collision energy.

If the negative ion beam passes through the neutral particle gas, then the collision between the negative ion and the neutral particle gas readily causes separation of excess electrons such as most outer shell electrons from the negative ions efficiently. A low energy of about 3 eV is necessary to cause electron separation from $Cl^-$. Therefore, it is possible to obtain a neutral particle beam with a sufficiently large intensity only by passing the negative ion beam through the neutral gas or plasma gas. The momentum having been possessed by the negative ions remains unchanged when the negative ion beam becomes the neutral particle beam.

In the foregoing embodiments, the neutralized bean is directly irradiated onto the substrate. Notwithstanding, it is possible to apply the neutral particle beam with a field in a direction vertical thereto so as to deflect orbit of an extremely small amount of any charged particle which might exist in the neutral particle beam to prevent any charged particle including electron from irradiation onto the substrate. As a result, only neutral particles are irradiated onto the substrate.

The ON-time and OFF-time of the micro-wave power source are not limited to the above values but are set in accordance with a dissociation reaction speed. Namely, the OFF-time is set sufficiently long for generating a sufficient amount of negative ions but shorter than a time duration in which electrons disappear. The ON-time is set for allowing recovery of the dropped density of electrons of the plasma.

Although in the foregoing embodiments, the grid electrode is always applied with a predetermined constant voltage for fetching negative ions from the plasma, it is also possible to apply a predetermined voltage to the grid only in the OFF-time during which the negative ions are generated. In the power ON state, a transitional variation in the number of negative ions appears. By contrast, in the power OFF state, a large amount of the negative ions is generated whereby the number of fetched negative ions is stable. For which reason, the negative ions are fetched from the plasma only in the power OFF state to facilitate setting the beam intensity accurately to match the etching conditions.

It is preferable to irradiate an ultra-violet ray with a short wavelength and a high energy to the negative ion beam to cause neutralization of the negative ions so that the negative ion beam become the neutral particle beam.

Whereas modifications of the present invention will be apparent to a person having ordinary skill in the art, to which the invention pertains, it is to be understood that embodiments as shown and described by way of illustrations are by no means intended to be considered in a limiting sense.

Accordingly, it is to be intended to cover by claims any modifications of the present invention which fall within the spirit and scope of the present invention.

What is claimed is:

1. A neutral particle beam treatment apparatus comprising:

a plasma generator provided for generating a plasma from a treatment gas by alternation of application and discontinuation of a high frequency field;

a negative ion accelerator provided for fetching negative, ions from said plasma generated by said plasma generator and acceleration thereof to cause a negative ion beam; and a neutralizer provided for neutralizing said negative ion beam to cause a neutral particle beam.

2. The neutral particle beam treatment apparatus as claimed in claim 1, wherein said plasma generator comprises:

a filed application discontinuation means provided for discontinuation of the application of the high frequency field for a time which is longer than a time when electrons in the plasma are bonded with residual gas generate a negative ion gas but shorter than a time when the electron density of the plasma is dropped to have the plasma disappear;

a high frequency field application means provided for applying a high frequency field for a sufficient time for recovery of the dropped electron energy of the plasma; and a repeater provided for repeating the application of the high frequency field and the discontinuation thereof.

3. The neutral particle beam treatment apparatus as claimed in claim 1, wherein said negative ion accelerator comprises:

a grid electrode; and a voltage supplier for supplying a positive bias to the grid electrode.

4. The neutral particle beam treatment apparatus as claimed in claim 1, wherein said negative ion accelerator fetches the negative ion from the plasma and accelerate them during when the application of the high frequency field is discontinued.

5. The neutral particle beam treatment apparatus as claimed in claim 1, wherein said neutralizer comprises a light source which irradiate a light to the negative ion beam.

6. The neutral particle beam treatment apparatus as claimed in claim 1, wherein said neutralizer is provided with an electrode and a high frequency power supplier for supplying a high frequency voltage to the electrode.

7. The neutral particle beam treatment apparatus as claimed in claim 1, wherein said neutralizer comprises an electron beam irradiator for irradiation of the electron beam to the negative ion.

8. The neutral particle beam treatment apparatus as claimed in claim 1, wherein said neutralizer is a gas introduction section which introduces gas on a path of the negative ion beam.

* * * * *